US006788755B2

(12) United States Patent
Weber et al.

(10) Patent No.: US 6,788,755 B2
(45) Date of Patent: Sep. 7, 2004

(54) SAFE LIFT AND PROCESS FOR TRANSPORTING CANISTERS OF SPENT NUCLEAR FUEL

(75) Inventors: David P. Weber, Oley, PA (US); Oddvar Norheim, Douglassville, PA (US)

(73) Assignee: American Crane & Equipment Corporation, Douglassville, PA (US)

( * ) Notice: Subject to any disclaimer, the term of this patent is extended or adjusted under 35 U.S.C. 154(b) by 0 days.

(21) Appl. No.: 10/341,654

(22) Filed: Jan. 14, 2003

(65) Prior Publication Data

US 2003/0231733 A1 Dec. 18, 2003

Related U.S. Application Data

(63) Continuation-in-part of application No. 10/172,185, filed on Jun. 14, 2002, now Pat. No. 6,674,828.

(51) Int. Cl.[7] ..... G21C 19/32

(52) U.S. Cl. ..... 376/262; 376/260; 376/272; 212/270; 414/146; 414/800

(58) Field of Search ..... 376/260–264, 376/272; 212/270; 414/146, 800

(56) References Cited

U.S. PATENT DOCUMENTS

| | | | | |
|---|---|---|---|---|
| 3,765,549 | A | 10/1973 | Jones | |
| 4,450,134 | A | 5/1984 | Soot et al. | |
| 4,610,839 | A | 9/1986 | Geier et al. | |
| 4,818,878 | A | 4/1989 | Popp et al. | |
| 5,319,686 | A | 6/1994 | Pizzano et al. | |
| 5,546,436 | A | 8/1996 | Jones et al. | |
| 5,841,147 | A | 11/1998 | Steinke et al. | |
| 5,898,747 | A | 4/1999 | Singh | |
| 5,998,800 | A | 12/1999 | Geinitz et al. | |
| 6,674,828 | B1 * | 1/2004 | Weber et al. | 376/272 |
| 2003/0006207 | A1 * | 1/2003 | Norheim | 212/274 |

FOREIGN PATENT DOCUMENTS

| | | | | |
|---|---|---|---|---|
| JP | 0046 983 | * | 2/2000 | 376/260 |
| WO | WO98/53460 | | 11/1998 | |

OTHER PUBLICATIONS

Nuclear Engineering International, Oct. 1990, pp 105–107, Holt.*

Holtec Hightlights (A Summary Report to our Clients, Suppliers and Company Personnel); UST&D's Dry Storage Equipment Output Soars; Mar. 7, 2001; p. 1–11.

Holtec Highlights (A Summary Report to our Clients, Suppliers and Company Personnel); The Cask Transfer Facility and MPC Automated Welding System Demonstrations are a Success; Oct. 5, 2000; p. 1–3.

* cited by examiner

*Primary Examiner*—Harvey E. Behrend
(74) *Attorney, Agent, or Firm*—Knoble Yoshida & Dunleavy, LLC

(57) ABSTRACT

A system and method for moving a canister of spent nuclear fuel from a first location, which may be within a nuclear power generation facility to a second location such as a storage cask that is used for short-term or long-term storage of spent nuclear fuel includes a first lifting mechanism for engaging a transfer cask and a second lifting mechanism for engaging and lifting the canister of spent nuclear fuel. Preferably, the method is practiced by first positioning a canister of spent nuclear fuel within the transfer cask and then engaging the transfer cask with the first lifting mechanism. The canister is engaged with the second lifting mechanism. The transfer cask having the canister positioned within is moved to the vicinity of a storage cask, and the canister is lowered from the transfer cask into the storage cask by the second lifting mechanism without disengagement of the first lifting mechanism from the transfer cask. Ideally, the second lifting mechanism is mounted on a portion of the first lifting mechanism that is relatively free from relative movement with respect to the transfer cask during operation. Accordingly, the lowering of the canister may be performed with a minimum of relative movement between the canister and the transfer cask, obviating or reducing the necessity for supplemental tiedowns of the transfer cask during this procedure, which is an inefficient process that if performed incorrectly can expose humans to unwanted radiation.

2 Claims, 11 Drawing Sheets

SAFE LIFT AND PROCESS FOR TRANSPORTING CANISTERS OF SPENT NUCLEAR FUEL

This is a continuation-in-part of application Ser. No. 10/172,185, filed Jun. 14, 2002, now U.S. Pat. No. 6,674,828, the entire content of which is hereby incorporated by reference as if set forth fully herein.

BACKGROUND OF THE INVENTION

1. Field of the Invention

This invention relates to overhead hoists or crane systems that are used to transfer especially sensitive or critical loads such as nuclear waste.

2. Description of the Related Technology

A nuclear reactor operates by facilitating a controlled nuclear chain reaction in a reactor core. Typically, the nuclear reaction is fueled by an isotope of uranium, which is supplied to the reactor core in a plurality of elongated fuel rods, which are typically metallic structures that are packed with uranium pellets. Periodically, the fuel rods must be removed and replaced, and the spent nuclear fuel must be safely moved and then stored to avoid contamination of the environment. This spent nuclear fuel remains highly radioactive and is also capable of generating significant thermal energy.

Spent nuclear fuel is preferably stored in a water filled pool or cask. Immersion in water not only dissipates the thermal energy that is generated, it helps in the attenuation of the radiation that is emitted from the spent nuclear fuel. Accordingly, although dry storage and transportation systems are available, spent nuclear fuel is typically shipped from one location to another in sealed, shielded containers that are typically referred to as casks. In certain facilities, spent nuclear fuel is transferred from a first location to a storage cask by first packing the spent nuclear fuel within a canister, and placing the canister within a temporary transfer cask. The transfer cask is lifted by a crane assembly that, according to federal regulations must be designed so that it is single failure proof, and is positioned immediately above a more permanent storage cask. While the temporary transfer cask and the canister remain suspended above the storage cask by the crane assembly, a combination of human and robotic activity is used to tie down the transfer cask so as to immobilize the transfer cask against potentially destabilizing movement with respect to the storage cask. The crane assembly is then disconnected from the transfer cask, and is subsequently connected to the top of the canister. A gate assembly at the bottom of the transfer cask is opened, and the canister is lowered out of the transfer cask and into the storage cask by the crane assembly until it is completely positioned within the more permanent storage cask. The crane assembly must then be disconnected from the canister and reconnected to the temporary transfer cask. The tie-downs are removed, and the temporary transfer cask is withdrawn.

While the foregoing process has been performed innumerable times safely and in compliance with applicable regulations, it requires a substantial amount of time and skill to perform. In addition, to the extent that human labor is needed to immobilize the transfer cask and to undo the immobilization at the end of the procedure there is a risk that personnel may be subjected to potentially harmful radiation.

A need exists for an improved system and process for transferring spent nuclear fuel from a first location to a storage cask that is more time and material efficient than the conventional process described above, and that furthermore minimizes the probability that humans will be placed in a position where they may be exposed to potentially harmful radiation.

SUMMARY OF THE INVENTION

Accordingly, it is an object of the invention to provide an improved system and process for transferring spent nuclear fuel from a first location to a storage cask that is more time and material efficient than the conventional process described above, and that furthermore minimizes the probability that humans will be placed in a position where they may be exposed to potentially harmful radiation.

In order to achieve the above and other objects of the invention, an apparatus for moving a canister of spent nuclear fuel from a first location to a storage cask includes a first lifting mechanism for engaging and lifting a transfer cask in which a canister of spent nuclear fuel is temporarily positioned, the first lifting mechanism comprising a lower engagement assembly that is substantially without freedom of movement with respect to the transfer cask when the first lifting mechanism is engaged with said transfer cask; a second lifting mechanism, the second lifting mechanism being constructed and arranged to engage an upper portion of the canister of spent nuclear fuel, and wherein the second lifting mechanism is mounted on the lower engagement assembly of the first lifting mechanism, whereby the canister of spent nuclear fuel may be lowered with respect to the transfer cask while the first lifting mechanism remains engaged with the transfer cask.

According to a second aspect of the invention, an apparatus for moving a canister of spent nuclear fuel from a first location to a storage cask includes a trolley assembly; a first single failure proof lifting mechanism mounted for movement with the trolley assembly for engaging and lifting a transfer cask in which a canister of spent nuclear fuel is temporarily positioned; and a second single failure proof lifting mechanism mounted for movement with the trolley assembly for engaging and lifting the canister of spent nuclear fuel.

According to a third aspect of the invention, a method of retrofitting an overhead crane assembly at a nuclear facility into a mobile nuclear cask transfer assembly, includes steps of removing a preexisting trolley from at least one travel rail of an overhead crane assembly; installing a mobile nuclear cask transfer assembly onto the at least one travel rail, the mobile nuclear cask transfer assembly comprising a trolley assembly, a first single failure proof lifting mechanism mounted for movement with the trolley assembly for engaging and lifting a transfer cask in which a canister of spent nuclear fuel is temporarily positioned, and a second single failure proof lifting mechanism mounted for movement with the trolley assembly for engaging and lifting the canister of spent nuclear fuel.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
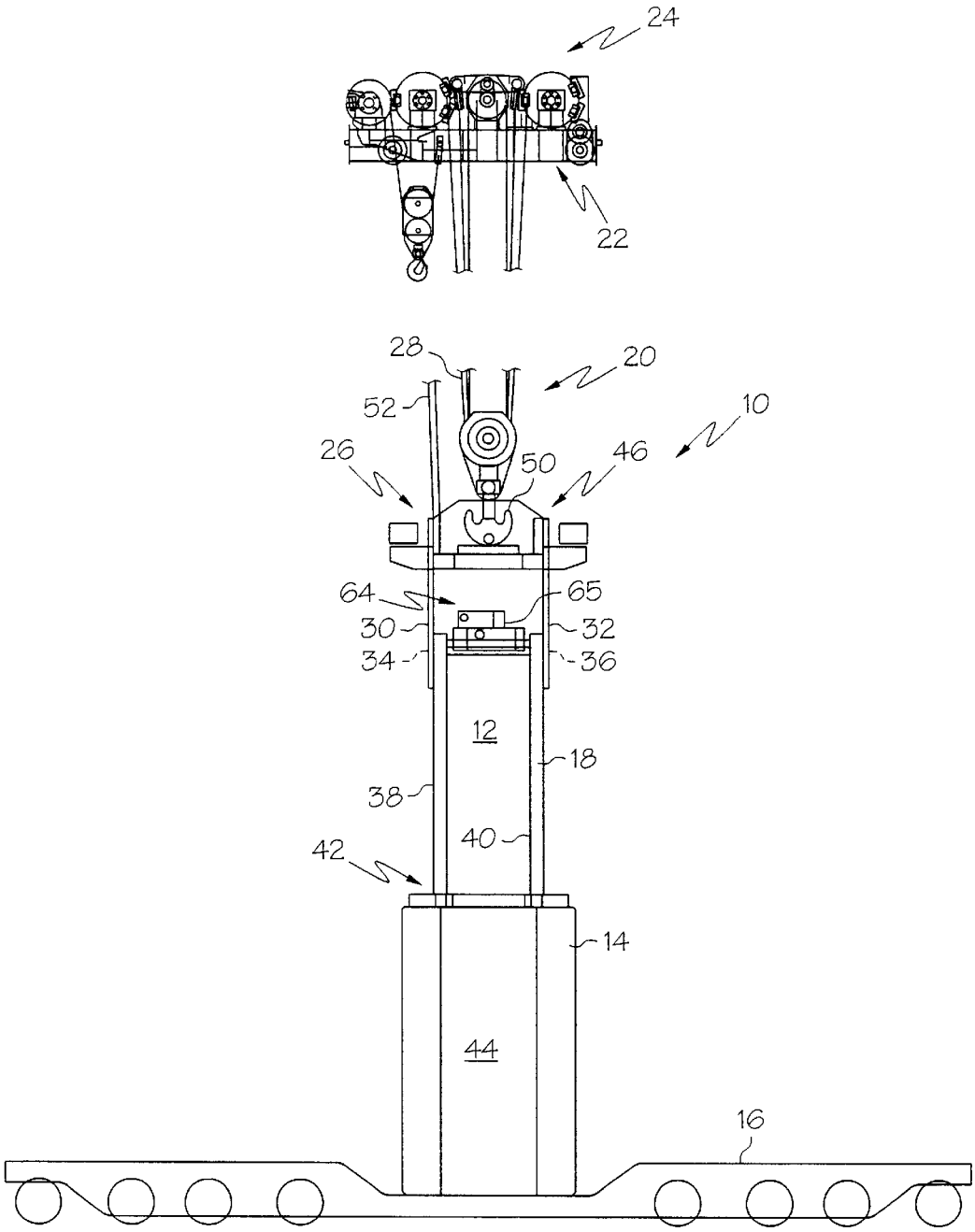
FIG. 1 is a diagrammatical depiction of a system for moving a canister of spent nuclear fuel that is constructed according to a preferred embodiment of the invention.

Referring now to the drawings, wherein like reference numerals designate corresponding structure throughout the views, and referring in particular to FIG. 1, a system 10 for moving a canister 12 of spent nuclear fuel to a storage cask 14 according to a preferred embodiment of the invention is depicted with the storage cask 14 being mounted for transport upon a trolley 16. As may be seen in FIG. 1, system 10 utilizes a transfer cask 18 into which the canister 12 is temporarily positioned while it is being moved from a first location to a final resting space 44 that is defined within the storage cask 14. As is conventional, transfer cask 18 is preferably fabricated from steel and has a pair of opposed lifting lugs 34, 36 that are integral with an outer wall 38 thereof. Lifting lugs 34, 36 may be used to lift and reposition the transfer cask 18 during operation. Transfer cask 18 further has an internal space defined by an inner wall 40 for receiving the canister 12 and a gate mechanism 42 positioned at the bottom thereof for retaining the canister 12 until it is properly positioned to be lowered into the storage cask 14.

Referring again to FIG. 1, it will be seen that system 10 further includes a first lifting mechanism 20 for engaging the transfer cask 18 and moving the transfer cask 18 from a first position to a position that is immediately adjacent to and above the storage cask 14. In the preferred embodiment, first lifting mechanism 20 is constructed as a single failure proof crane 22 having an upper block assembly 24 and a lower block assembly 26 that is suspended from the upper block assembly 24 by a reeving arrangement 28. Suspended from the lower block assembly 26 is a first lifting hook that is configured and spaced and sized so as to be able to engage the first lifting lug on the transfer cask 18 and a second lifting hook that is likewise constructed for engaging the opposed second lifting lug 36 during operation. It should be understood that the description of the lifting hooks as being suspended from the lower block assembly 26 should be construed as descriptive of any mechanical arrangement wherein the lifting hooks move substantially with the lower block assembly 26, regardless of whether they are actually mounted on the lower block assembly or one another component, such as part of the hoist mechanism, that in turn is mounted on the lower block assembly.

Figure 5:
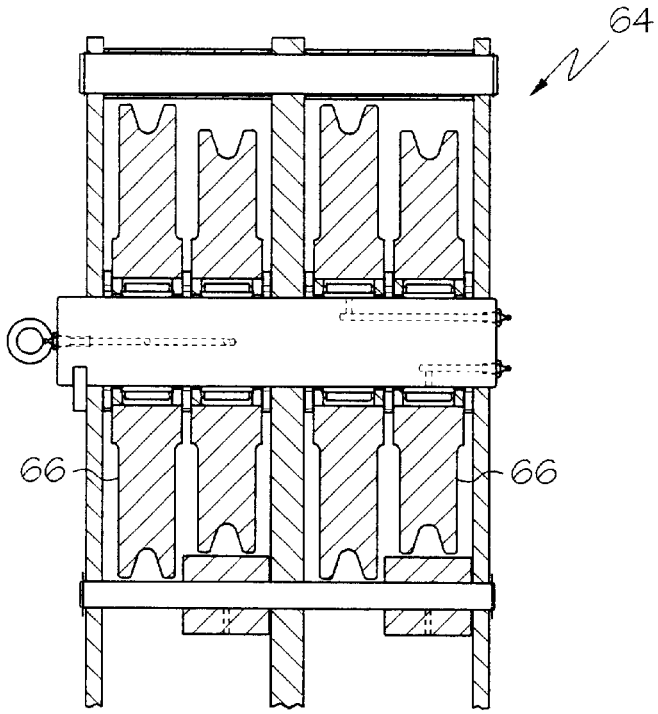
FIG. 5 is a cross-sectional view, taken along lines 5—5 in FIG. 2, depicting a portion of a reeving arrangement of a hoist assembly that is used to lift the grab assembly shown in FIGS. 2–4.
Figure 6:
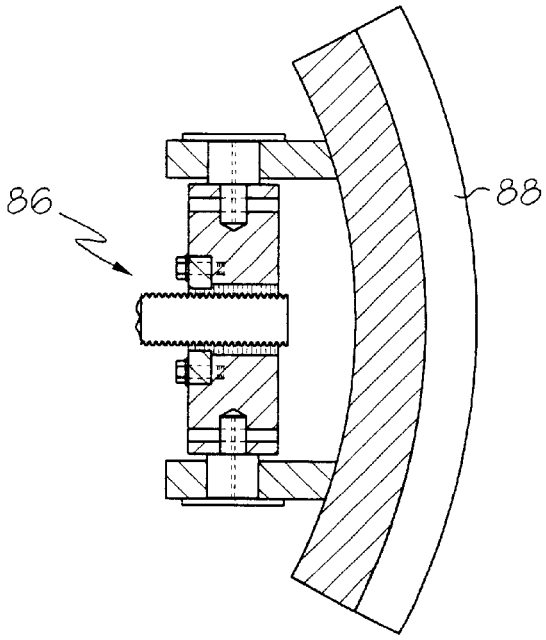
FIG. 6 is a partial cross-sectional view, taken along lines 6—6 in FIG. 2, depicting a canister ring hook assembly that is provided in the grab assembly shown in FIGS. 3 and 4.
Figure 7:
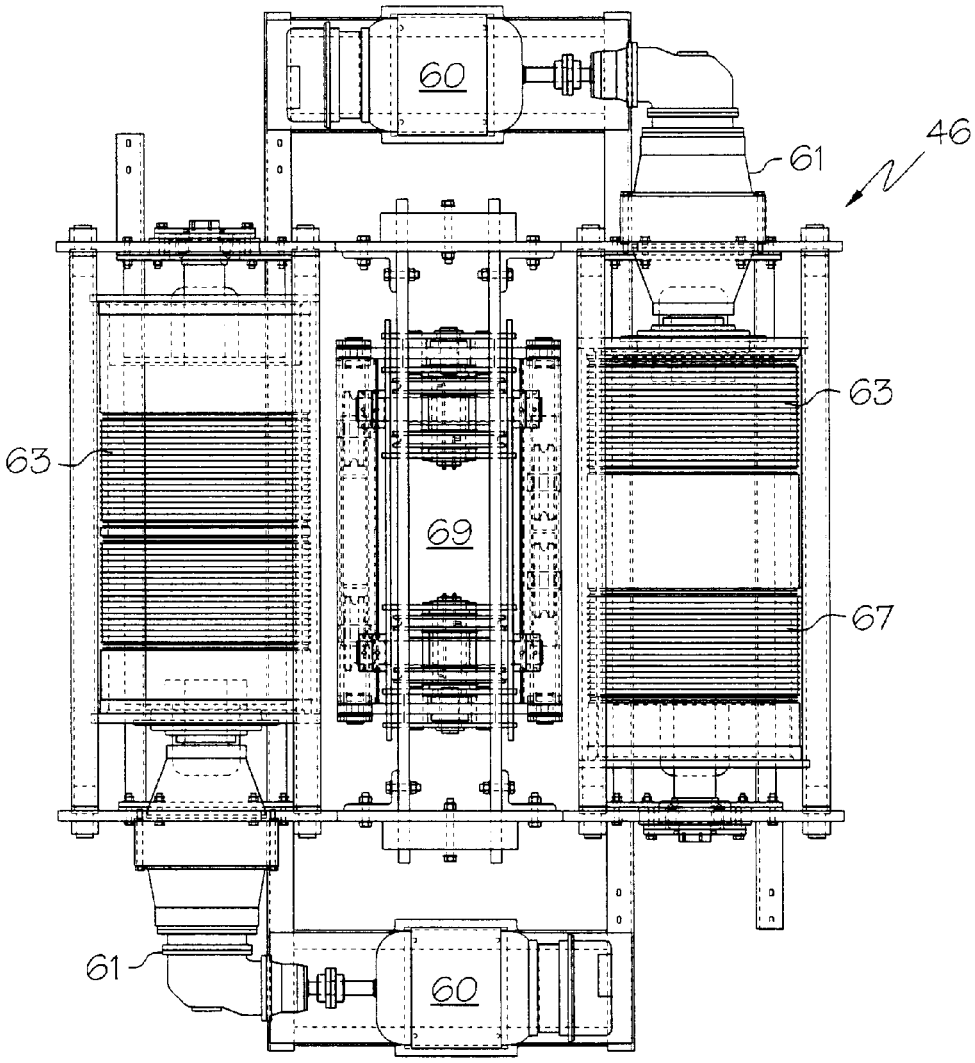
FIG. 7 is a top plan view of a hoist mechanism that is used to lower into raise the grab assembly in the preferred embodiment of the invention.

System 10 advantageously further includes a second lifting mechanism 46 that in the preferred embodiment is attached to the lower block assembly 26 of the first lifting mechanism 20. As may be seen in the top plan view of the second lifting mechanism that is depicted in FIG. 7, the second lifting mechanism 46 is preferably embodied as a hoist 58 that is powered by a redundant pair of electric motors 60 and that is constructed and arranged to raise and lower a specialized canister grab system 64 that will engage a lid portion 65 of the canister assembly 12, as will be described in greater detail below with reference to FIG. 8. As may be seen in FIG. 7, hoist 58 includes a corresponding pair of planetary reduction gears 61 that are part of a drive train from the motors 60 to a pair of drums 63 about which are wound at least two cables or ropes, which in turn our arranged in a reeving arrangement 67 parts of rope and a plurality of sheaves 66 (best shown in FIG. 5) that are mounted to a frame assembly 48 of the canister grab system 64. An electric motor 50 is provided to engage and disengage canister grab system 64 with the lid portion 65, as will be described in greater detail below.

Figure 2:
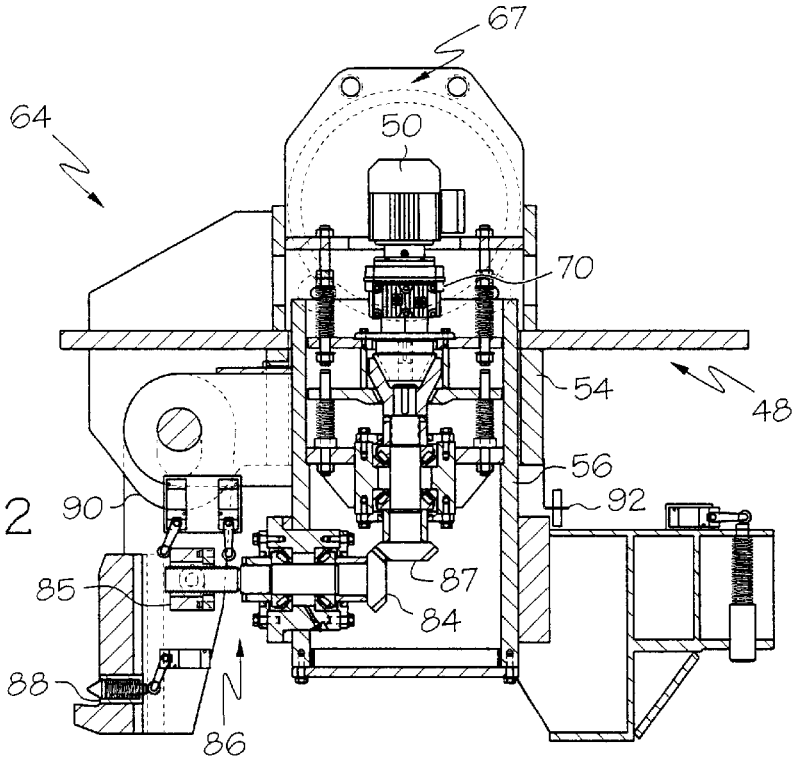
FIG. 2 is a cross-sectional view depicting a portion of a grab assembly that is used in the preferred embodiment of the invention, shown in a first operational position.
Figure 3:
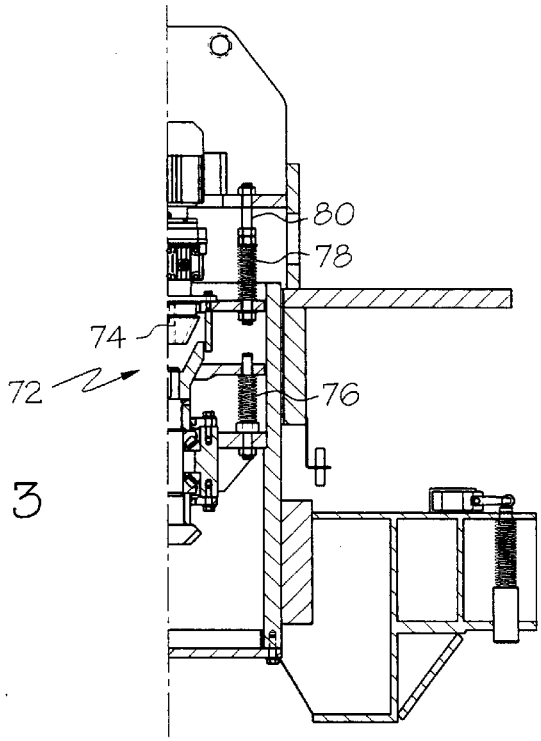
FIG. 3 is a partial cross-sectional view, similar to that provided in FIG. 2, depicting the grab assembly in a second operational position.
Figure 4:
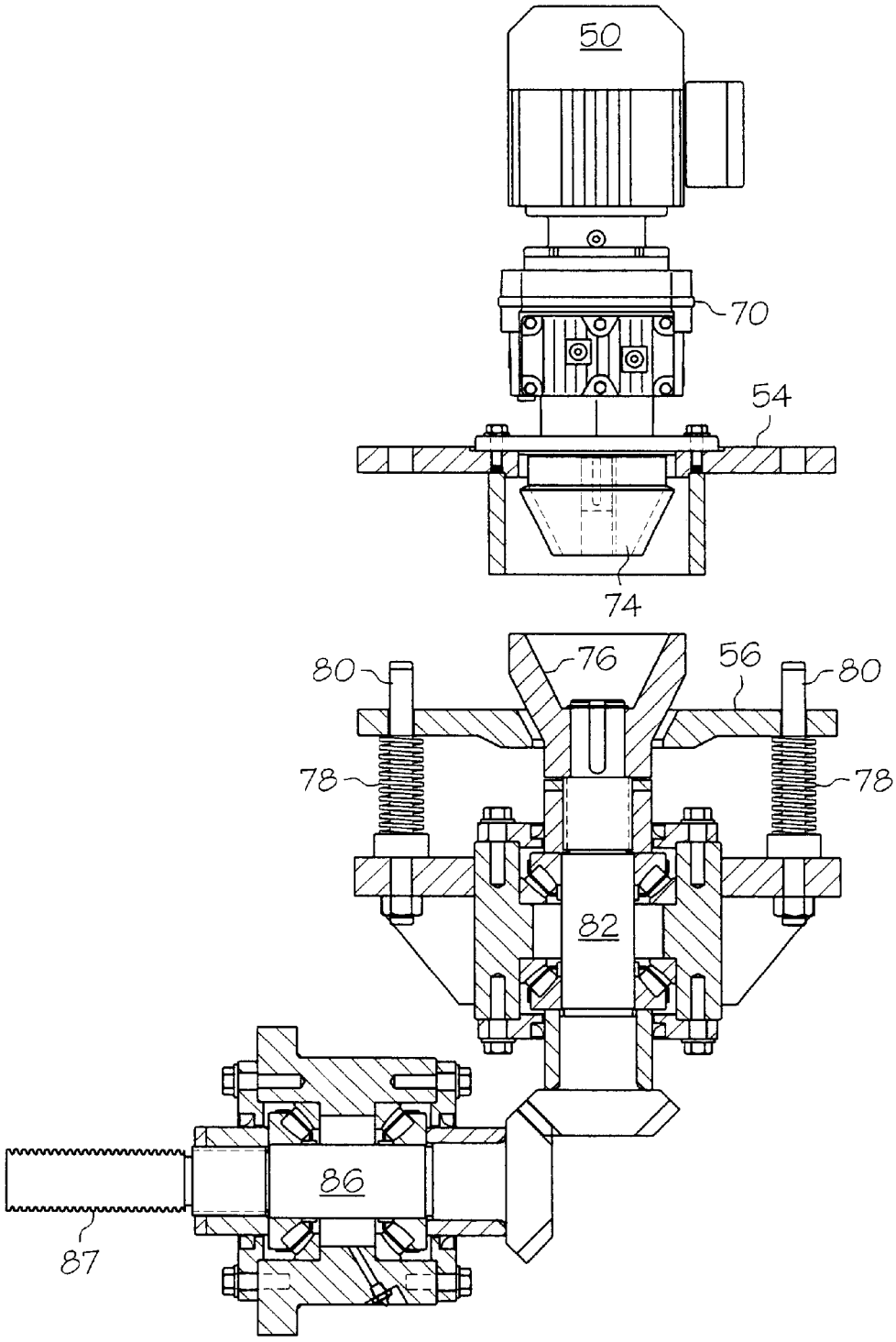
FIG. 4 is a partially exploded fragmentary cross-sectional view depicting a drive train that is used in the grab assembly that is depicted in FIGS. 2 and 3.

Referring now to FIGS. 2–4, it will be seen that electric motor 50 is coupled to a reduction gear 70 that in turn is connected to an interlock assembly that ensures that the grab system 64 will be constrained to remain engaged with the lid portion 65 when any substantial amount of weight of the canister 12 is borne by the second lifting mechanism 46. As may best be seen in FIG. 4, an interlock assembly is preferably constructed as a clutching arrangement in a bevel drive 72 that includes a first, male, conical drive member 74 and a second, female conical drive member 76. As may be seen by comparing the positions of the grab system 64 and FIGS. 2 and 3, the frame assembly 48 is divided into an upper grab frame assembly 54 and a lower grab frame assembly 56 that is mounted so as to be permitted to travel a predetermined vertical distance $D_T$ with respect to the upper grab frame assembly 54. As may best be seen in FIG. 4, a system of biasing springs 78 and pins 80 are provided to bias the upper and lower grab frame assemblies 54, 56 together so that under normal circumstances the first male conical drive member 74 remains frictionally engaged with the second female conical drive member 76, ensuring an intact drive train between the reduction gear 70 and a drive shaft 82 as is shown in FIG. 2. Drive shaft 82 is coupled to a screw drive arrangement 86 by means of a bevel gear 84.

Screw drive arrangement 86 includes a shaft 87 that is provided with an external helical thread and that is interengaged with a mating internally threaded sleeve 89 that is integral with the canister ring hook 88. Accordingly, rotation of the shaft 82 in a first direction will tend to extend a canister ring hook 88 and rotation in a second, opposite direction will tend to retract the canister ring hook 88. A limit switch 90 is positioned as is shown in FIG. 2 to monitor the travel of the canister ring hook 88. When the canister ring hook 88 is in the retracted position, the canister grab assembly will be able to engage the lid member 65 of the canister 12. When the canister ring hook 88 is in the fully extended position, the canister grab system 64 will be securely locked into the lid portion 65 of the canister 12. When the canister grab system 64 bears the weight of the canister 12, the lower grab frame assembly 56 will be pulled downwardly with respect to the upper grab frame assembly 54, against the biasing of springs 78, and the first conical drive member 74 will disengage from the second conical drive member 76. Accordingly, when the second lifting mechanism 46 is effectively bearing the weight of the canister 12, the canister grab system 64 will be unable to disengage from the canister 12.

Figure 8:
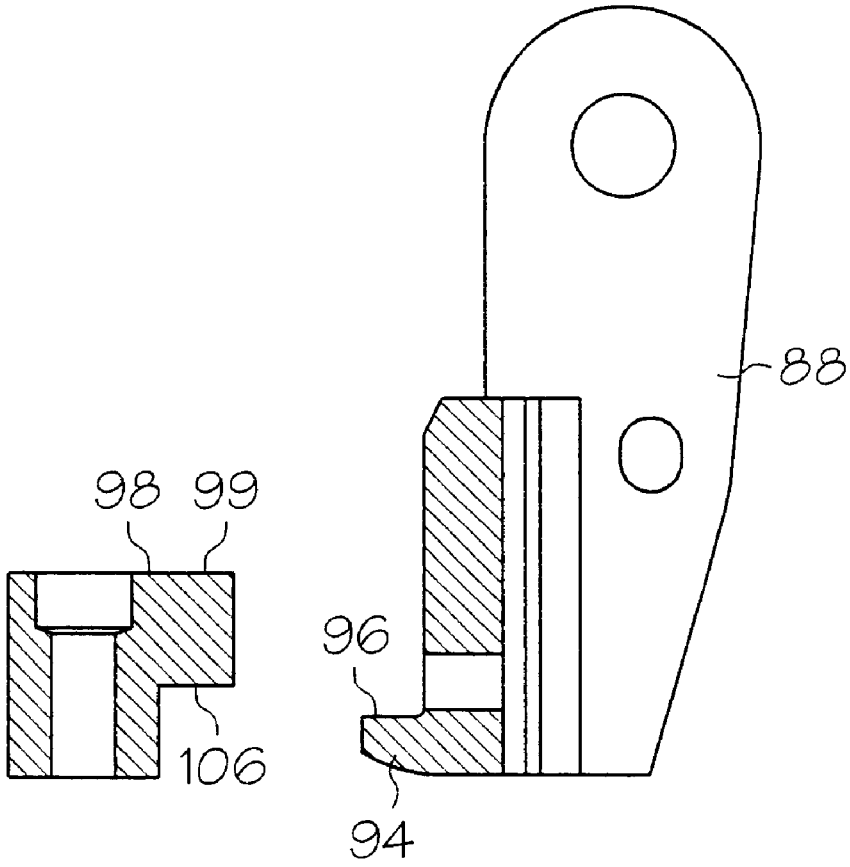
FIG. 8 is a partial cross-sectional depiction showing an interaction between the canister ring hook assembly and a portion of a canister for storing spent nuclear fuel.

Referring now to FIG. 8, it will be seen that the canister ring hook 88 includes at its circumferentially outer extreme lower end a projection 94 for engaging the ring member 98 that is bolted to the lid portion 65 of the canister 12. As may be seen in FIG. 8, ring member 98 also includes an inwardly extending projection 99 that has a lower surface 100. According to one important aspect of the invention, the lower surface 100 of the projection 99 on the ring member 98 and an upper surface 96 of the projection 94 are both angled so as to tend to retain the canister ring hook 88 to the ring member 98 that any time during operation that the weight of the canister 12 is resting to any significant extent on the canister ring hook 88. Preferably, each of these surfaces is angled within a range of about 2 degrees to about 10 degrees with respect to horizontal. More preferably, each of these surfaces is angled by about 6 degrees with respect to the horizontal.

Figure 9:
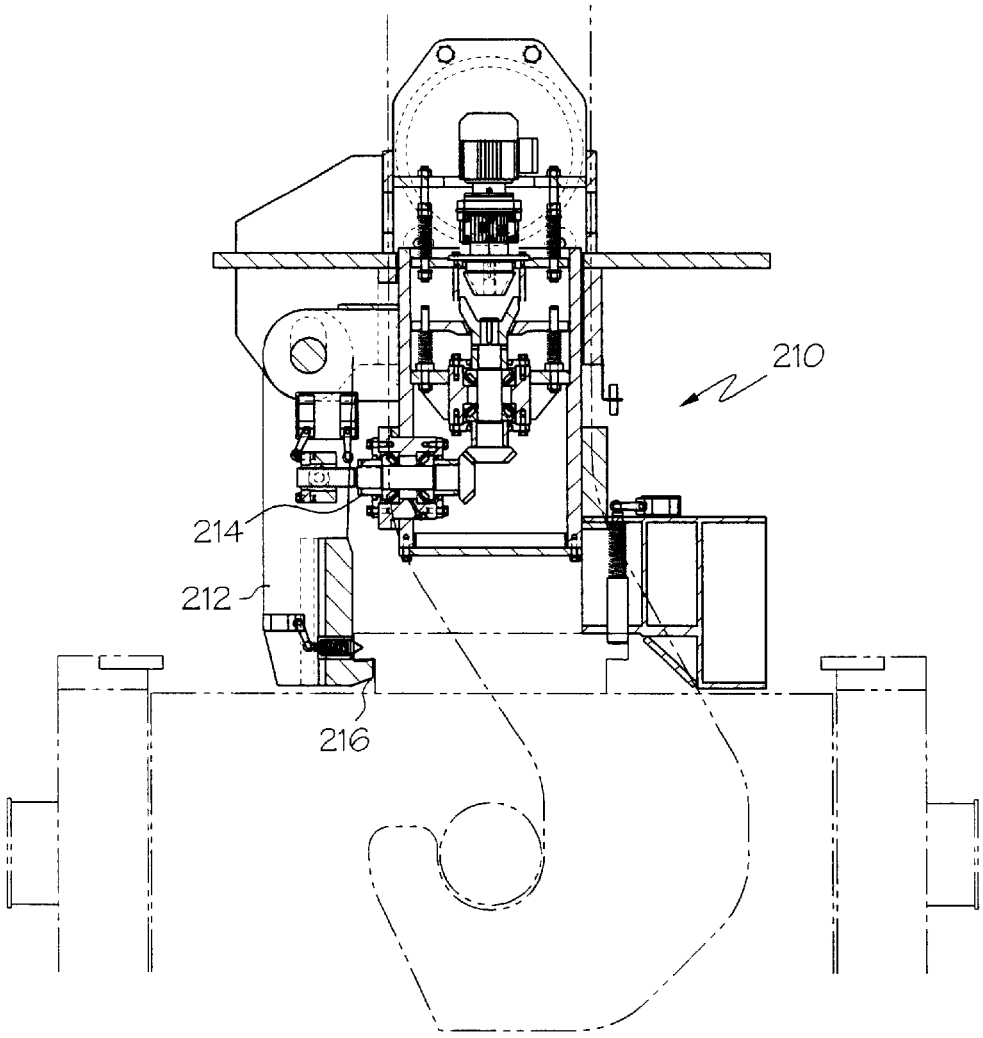
FIG. 9 is a partial cross-sectional depiction depicting a grab assembly that is constructed according to a second embodiment of the invention.

FIG. 9 depicts a grab assembly 210 that is constructed according to a second, alternative embodiment of the invention. Grab assembly 210 is identical to the grab assembly described above in reference to the first embodiment, except that it is configured to engage a canister lid assembly of slightly different construction by radially retracting the canister ring hook assembly 212. Accordingly, a screw drive arrangement 214 is provided that has a threading that is opposite from that of the screw drive arrangement 86 of the first embodiment. The canister ring hook assembly in the second embodiment has a projection 216 that faces inwardly, as may be seen in FIG. 9.

In operation, the canister 12 will first be positioned and secured within the transfer cask 18 and the transfer cask 18 will then be engaged by the first lifting mechanism 20, specifically by engagement of the lifting hooks 30, 32 with the corresponding lifting lugs 34, 36 on the sides of the outer wall 38 of the transfer cask 18. At this point, the first lifting mechanism 20 and specifically the crane 22 will be used to move the transfer cask 18 and the enclosed canister 12 to a position (as is shown in FIG. 1) immediately above the storage cask 14. At any point in the process up to and including this point, the canister grab system 64 may be lowered automatically or by an operator by instructing the hoist 58 to be lowered into the proximity of the lid member 65 of the canister 12. The motor 50 will then be actuated, causing the canister ring hook 88 to extend, thereby locking the canister grab system 64 into the lid assembly 65. This is verified by the limit switch 90, which will so advise a remote human operator or an automated control system. At this point, while the first lifting system and 20 remains engaged with the transfer cask 18, the gate mechanism 42 at the lower end of the transfer cask 18 may be opened, preferably by remote control the hoist 58 may be instructed to lower the canister 12 into the space 44 that is defined within the storage cask 14. Because the canister grab system 64 is suspended from the lower block assembly 26, which also provides the lifting engagement with the transfer cask 18, relative stability is provided during this step of lowering the canister 12. Accordingly, is not necessary for the transfer cask 18 to be tied down using supplemental restraints which, as described above, is a time-consuming process in may also result in the exposure of humans to potentially harmful radiation. As the canister 12 is lowered, the bevel drive 72 will be pulled into the disengaged position that is shown in FIG. 4, so that the grab system 64 may not be accidentally disengaged. When the canister 12 is in the final storage position, the control system or remote human operator will instruct the electric motor 50 to disengage the canister ring hook 88 from the lid member 65 of the canister 12. The hoist 58 will then be instructed to retract the grab system 64, and the first lifting mechanism may then be instructed to transport the transfer cask to another location where it may be stored or used in a second transfer procedure.

Figure 10:
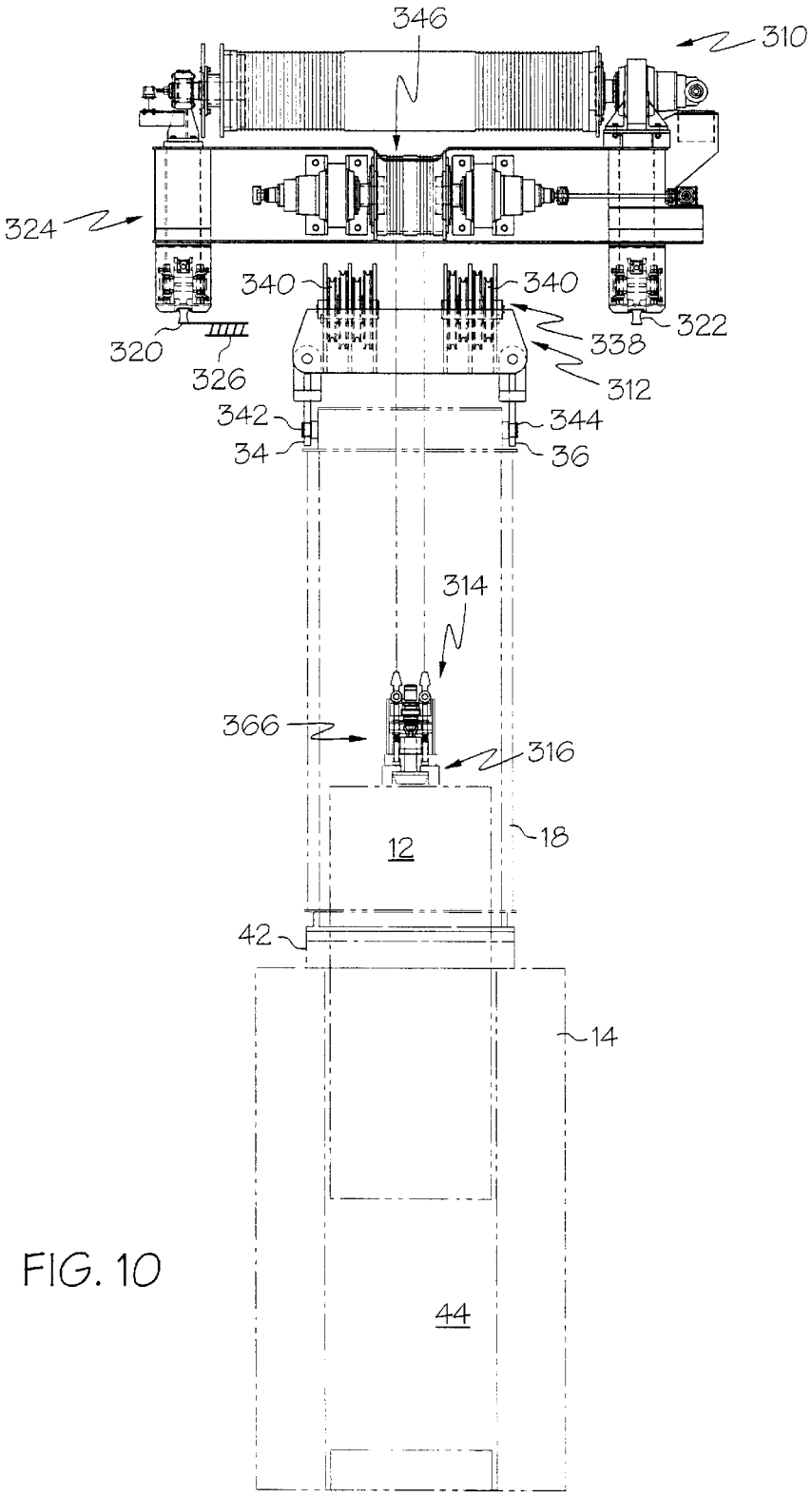
FIG. 10 is a partially diagrammatical depiction of a system constructed according to an alternative embodiment of the invention.

Referring to FIG. 10, an apparatus 310 for moving a canister of spent nuclear fuel that is constructed according to an alternative embodiment of the invention includes a first single failure proof lifting mechanism 312 for engaging and lifting a transfer cask 18 in which a canister 12 of spent nuclear fuel is temporarily positioned. Apparatus 310 further includes a second, independent single failure proof lifting mechanism 314 for engaging a lid assembly 316 of the canister 12 of spent nuclear fuel. As may be seen in FIG. 10, apparatus 310 further includes a trolley assembly 324 that is mounted so as to be able to travel on a pair of travel rails 320,322 that are preferably, although not necessarily, structurally mounted to a building 326.

Figure 11:
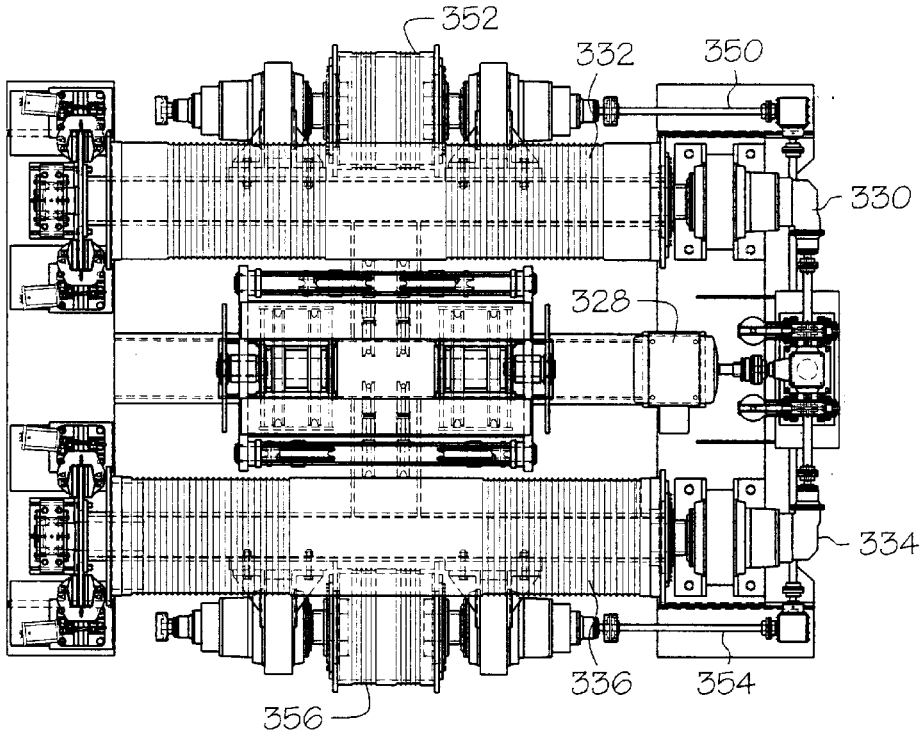
FIG. 11 is a top plan view of the system that is depicted in FIG. 10.

Referring briefly to FIG. 11, it will be seen that the first lifting mechanism 312 includes a drive motor 328 that is adapted to drive a first drive mechanism 330, which in turn causes movement of a first drum 332, as well as to drive a second drive mechanism 334, which is arranged to cause movement of a second drum 336. A plurality of parts of rope are paid out from the respective drums 332, 336 to raise or lower as may be desired a lower block assembly 338, best visible in FIG. 10, which includes a plurality of sheaves 340 for receiving and equalizing the parts of rope. The lower block assembly 338 further includes a first lifting member 342 and a second lifting member 344 that are constructed and arranged to be engageable with lifting lugs 34, 36 of the transfer cask 18. In this embodiment, lifting members 342, 344 are constructed so as to be shaped as closed hooks or eyelets, although they could alternatively be shaped as open hooks as was described in reference to the first embodiment of the invention.

Figure 12:
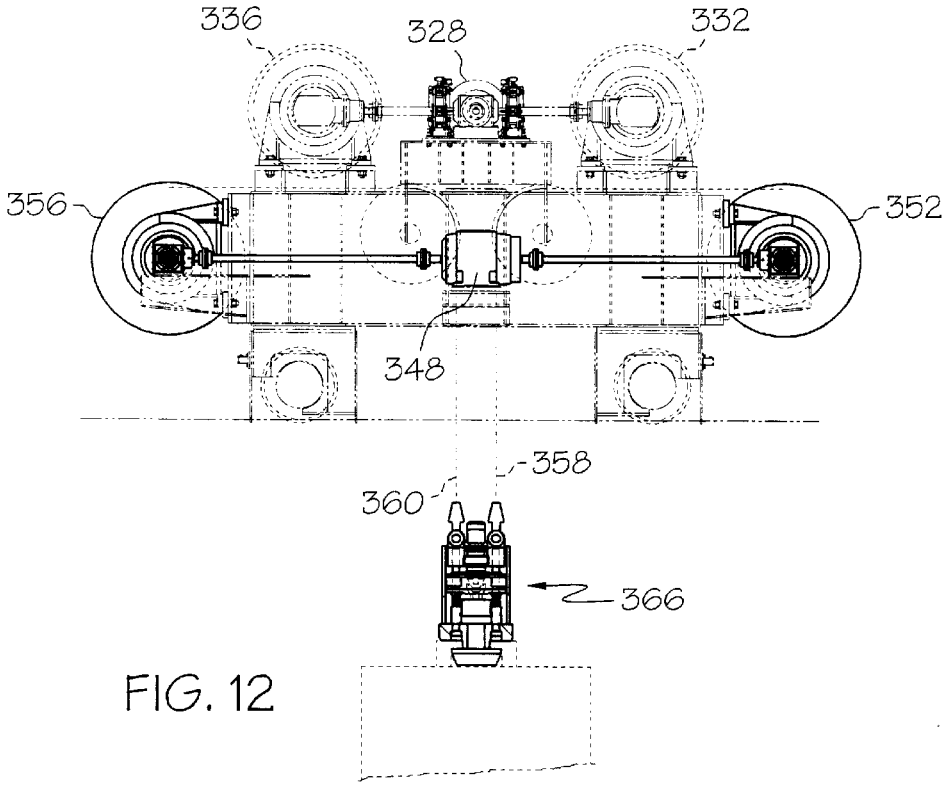
FIG. 12 is a partially diagrammatical side elevational view of the system that is depicted in FIG. 10.

Second lifting mechanism 314 is preferably embodied as a hoist 346 that, as may be seen in FIG. 12, includes a drive motor 348. Drive motor 348 is coupled to a first drive train 350 the drives a first hoist drum 352 as well as to a second drive train 354 that in turn is coupled to a second hoist drum 356. First and second pairs of wire ropes 358, 360 are respectively paid out of the hoist drums 352, 356 to control upward and downward movement of a canister grab mechanism 366. As is best shown in FIGS. 13 and 14, canister grab mechanism 366 includes a first pair of coupling mechanisms 362 that are coupled with the first pair 358 of wire ropes and a second pair of coupling mechanisms 364 that are likewise coupled to the second pair 360 of wire ropes.

Figure 14:
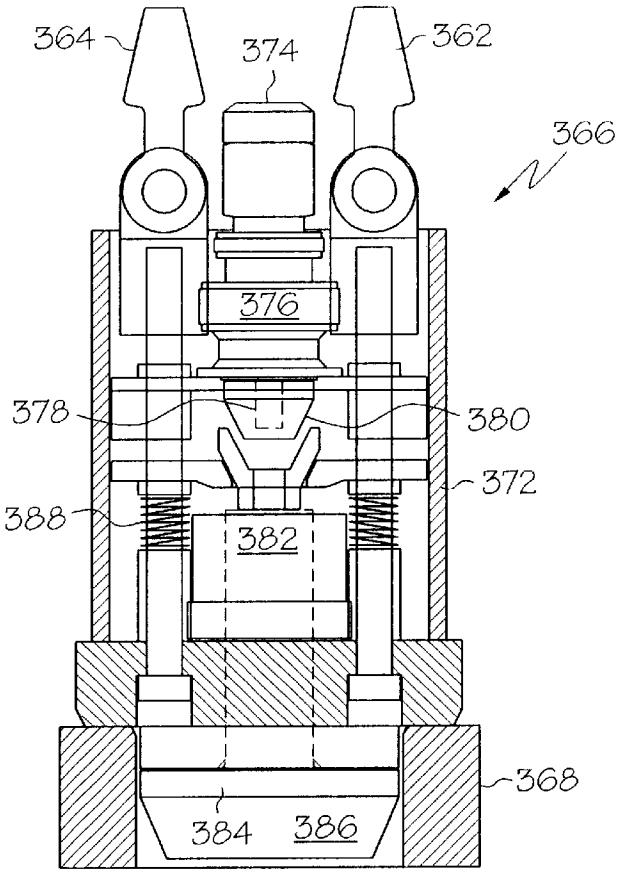
FIG. 14 is a cross-sectional view similar to that provided in FIG. 13, showing a second operational position.
Figure 13:
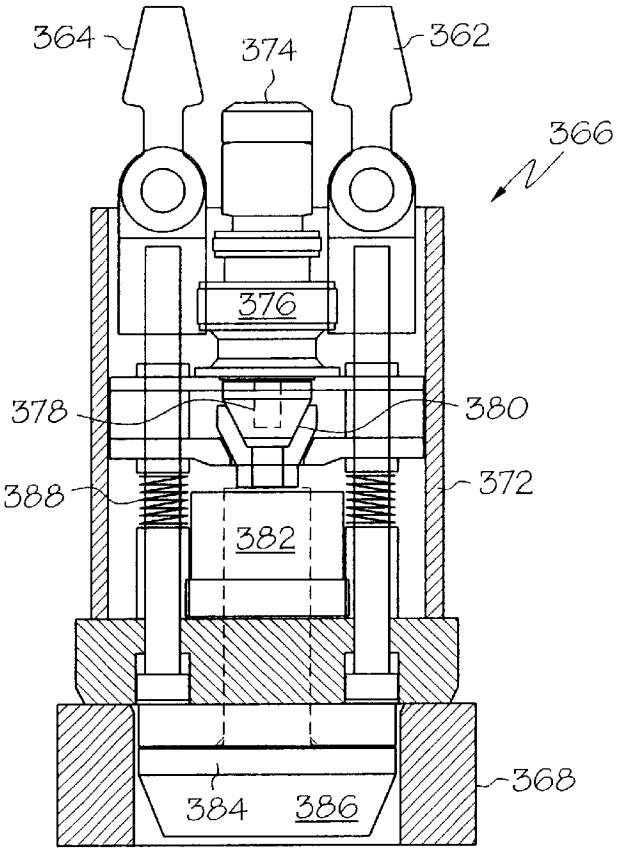
FIG. 13 is a cross-sectional view depicting a canister grab system according to the embodiment of FIG. 10, shown in a first operational position.
Figure 15:
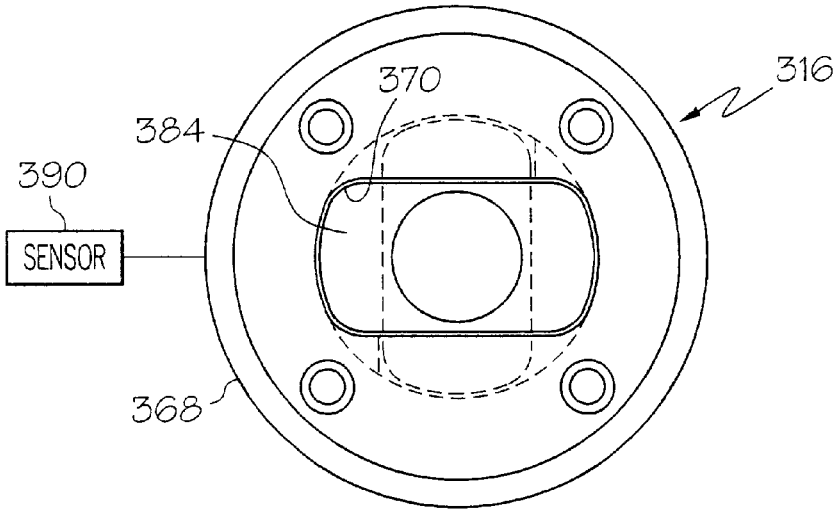
FIG. 15 is a diagrammatical depiction of the canister grab system shown in FIG. 13 engaging a canister.

As may be seen in FIGS. 13–15, canister 12 includes a lifting ring 368 that has an oblong opening 370 defined therein. Canister grab system 366 has an outer housing 372 to which is mounted a drive motor 374 that is adapted to drive a male conical drive member 378 via a reduction gear train 376. Male conical drive member 378 is positioned so as to be able to engage a female conical drive member 380 when the canister grab system 366 is not bearing the weight of the canister 12, in a manner that is identical to that described above with reference to the first embodiment of the invention. In this condition, the weight of members 374, 376, 378 urges the female conical drive member 380 into engagement with the male conical drive member 378. A pair of springs 388 provides braking for the members 374, 376, 378 when the lower portion of the grab mechanism 366 is bearing weight, thus preventing engagement of the drive members 378, 380. Female conical drive member 380 is coupled to rotate together with an engagement member 382 that includes a lower portion 384 that is constructed and arranged to engage the lid assembly 316 of the canister 12. Specifically, and as is best shown in FIG. 15, the lower portion 384 of the engagement member 382 is shaped so as to be able to fit through the oblong opening 370 of the lifting ring 368, and so that it will be locked within the lifting ring 368 after it has been inserted through the opening 370 and rotated so as to no longer be in registration with the opening 370, as will be described in greater detail below. The lower portion 384 of the engagement member 382 preferably has a lower beveled edge 386 to facilitate centering and location of the engagement member 382 with respect to the upper portion of a canister 12 during coupling. A sensor 390 may be provided to monitor the engagement status of the lower portion 384 of the engagement member 382 with the lifting ring 368. Sensor 390 may be embodied as a first sensor for sensing when the lower portion 384 is seated in the lifting ring 378 and a second sensor for sensing the rotational position of the lower portion 384 with lifting ring 378.

Figure 16:
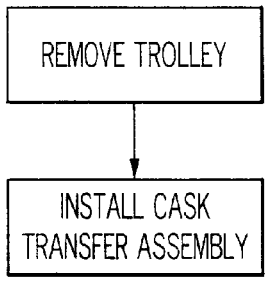
FIG. 16 is a schematic depiction of a method of retrofitting a facility according to the invention.

Apparatus 310 may be installed into a nuclear facility either as original equipment or by retrofitting an existing facility. In order to retrofit an existing facility, as is depicted schematically and FIG. 16, a pre-existing trolley must be removed from at least one travel rail of an overhead crane assembly in the facility. At that point, apparatus 310 may be installed so as to be mounted on the at least one travel rail and preferably a pair of travel rails 324, 322, in the manner that is depicted in FIG. 10.

In operation, the canister 12 will first be positioned and secured within the transfer cask 18 and the transfer cask 18 will then be engaged by the first lifting mechanism 312, specifically by engagement of the lifting members 342, 344 with the corresponding lifting lugs 34, 36 on the sides of the outer wall 38 of the transfer cask 18. At this point, the first lifting mechanism 312 will be used to move the transfer cask 18 and the enclosed canister 12 to a position (as is shown in FIG. 1) immediately above the storage cask 14. At any point in the process up to and including this point, the canister grab system 366 may be lowered automatically or by an operator by instructing the hoist 346 to be lowered into the proximity of the lid assembly 316 of the canister 12. The lower portion 384 of the engagement member 382 will be lowered through the opening 370 in the lid assembly 316, and the motor 374 will then be actuated, causing a engagement member 382 to rotate, thereby locking the engagement member into the lid assembly 316 as is depicted in FIG. 15. This is verified by the sensor 390, which will so advise a remote human operator or an automated control system. At this point, while the first lifting system 312 remains engaged with the transfer cask 18, the gate mechanism 42 at the lower end of the transfer cask 18 may be opened, preferably by remote control. The hoist 346 may be instructed to lower the canister 12 into the space 44 that is defined within the storage cask 14. Because the canister grab system 366 is suspended directly from the trolley assembly 324, rather than the lower block of the first lifting assembly. As was the case in the previously described embodiment, the overall height of the system is reduced, making it compatible with more facilities, particularly indoor facilities. In addition, the fact that the sensitive electrical parts of the hoist 346 are not suspended from the lower block of the first lifting mechanism makes the canister grab mechanism 366 less likely to be submerged in water during use, which is an important advantage. As was the case in the previously described embodiment, the fact that simultaneous engagement is provided with the transfer cask 18 and the canister 12 provides relative stability during the step of lowering the canister 12. Accordingly, is not necessary for the transfer cask 18 to be tied down using supplemental restraints which, as described above, is a time-consuming process in may also result in the exposure of humans to potentially harmful radiation. As the canister 12 is lowered, the conical drive members 378, 380 will be pulled into the disengaged position that is shown in FIG. 14, so that the grab system 366 may not be accidentally disengaged. When the canister 12 is in the final storage position, the control system or remote human operator will instruct the electric motor 374 to disengage the engagement member 382 from the lid assembly 316 of the canister 12. The hoist 346 will then be instructed to retract the grab system 366, and the first lifting mechanism may then be instructed to transport the transfer cask to another location where it may be stored or used in a second transfer procedure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of retrofitting an overhead crane assembly at a nuclear facility into a mobile nuclear cask transfer assembly, comprising steps of:

(a) removing a prexisting trolley from at least one travel rail of an overhead crane assembly;

(b) installing a mobile nuclear cask transfer assembly onto said at least one travel rail, said mobile nuclear cask transfer assembly comprising a trolley assembly, a first single failure proof lifting mechanism mounted for movement with said trolley assembly for engaging and lifting a transfer cask in which a canister of spent nuclear fuel is temporarily positioned, and a second single failure proof lifting mechanism mounted for movement with said trolley assembly for engaging and lifting the canister of spent nuclear fuel.

2. A method of retrofitting an overhead crane assembly at a nuclear facility into a mobile nuclear cask transfer assembly according to claim 1, wherein step (a) is performed within a building.

* * * * *